US009244404B2

(12) United States Patent
Takeuchi

(10) Patent No.: US 9,244,404 B2
(45) Date of Patent: Jan. 26, 2016

(54) FIXING DEVICE HAVING NIP MEMBER PROVIDED WITH PROTRUDING PORTION

(71) Applicant: Kenji Takeuchi, Nagoya (JP)

(72) Inventor: Kenji Takeuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/169,189

(22) Filed: Jan. 31, 2014

(65) Prior Publication Data

US 2014/0212190 A1 Jul. 31, 2014

(30) Foreign Application Priority Data

Jan. 31, 2013 (JP) ..... 2013-017140

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2053; G03G 15/2064; G03G 2215/2035
USPC ..... 399/329
See application file for complete search history.

(56) References Cited

U.S. PATENT DOCUMENTS

2011/0150544 A1* 6/2011 Ishida et al.
2011/0158715 A1 6/2011 Suzuki et al.
2011/0206409 A1* 8/2011 Kondo et al. ..... 399/329
2013/0164056 A1* 6/2013 Imada et al. ..... 399/329

FOREIGN PATENT DOCUMENTS

JP 2011-095551 A 5/2011

* cited by examiner

*Primary Examiner* — David Gray
*Assistant Examiner* — Laura Roth
(74) *Attorney, Agent, or Firm* — Banner & Witcoff, Ltd.

(57) ABSTRACT

A fixing device may include: an endless belt circularly movable about a first axis extending in an axial direction; a nip member and a heater extending in an internal space defined by an inner peripheral surface of the endless belt; and a rotary body disposed to be opposite to the heater with respect to the nip member. The nip member may slidingly contact the inner peripheral surface. The rotary body and the nip member may nip the endless belt therebetween. The nip member may include a main portion extending in the axial direction and having a first axial end portion; and a protruding portion protruding from the first axial end portion toward the heater, the protruding portion having a first surface configured to receive radiant heat from the heater.

21 Claims, 9 Drawing Sheets

FIXING DEVICE HAVING NIP MEMBER PROVIDED WITH PROTRUDING PORTION

CROSS REFERENCE TO RELATED APPLICATION

This application claims priority from Japanese Patent Application No. 2013-017140 filed Jan. 31, 2013. The entire content of the priority application is incorporated herein by reference.

TECHNICAL FIELD

The present invention relates to a fixing device provided in an electrophotographic image forming apparatus.

BACKGROUND

A conventional electrophotographic image forming apparatus (such as a later printer or digital copier) includes a fixing device that thermally fixes a developing agent image formed on a recording sheet thereto. Such conventional fixing device includes a flexible endless fusing film (or an endless belt), a heater disposed in an internal space of the fusing film, a nip plate disposed in the internal space and in sliding contact with an inner peripheral surface of the fusing film to receive radiant heat from the heater, and a pressure roller that nips the fusing film together with the nip plate to permit the endless fusing film to be circularly movable in a circumferential direction thereof.

In this fixing device, a developing agent image formed on a recording sheet is thermally fixed to the recording sheet with radiant heat from the heater while the recording sheet is nipped and conveyed between the pressure roller and the fusing film.

SUMMARY

In this fixing device, the nip plate has a small amount of heat capacity. Further, a relatively smaller amount of radiant heat from the heater can be transmitted to both longitudinal end portions of the nip plate, compared to a center portion of the nip plate. As a result, thermal fixation of a developing agent image to a recording sheet tends to become insufficient at widthwise end portions of the recording sheet (at longitudinal end portions of the nip plate).

In view of the foregoing, it is an object of the present invention to provide a fixing device capable of preventing occurrence of insufficient thermal fixation on widthwise end portions of a recording sheet.

In order to attain the above and other objects, there is provided a fixing device including an endless belt, a nip member, a heater and a rotary body. The endless belt may have an inner peripheral surface defining an internal space, the endless belt being configured to circularly move about a first axis extending in an axial direction. The nip member and heater may extend through the internal space. The rotary body may be disposed to be opposite to the heater with respect to the nip member, the rotary body and the nip member being configured to nip the endless belt therebetween. The nip member may include: a main portion extending in the axial direction and having a first axial end portion; and a protruding portion protruding from the first axial end portion of the main portion toward the heater, the protruding portion having a first surface configured to receive radiant heat from the heater.

According to another aspect of the present invention, there is provided a fixing device including an endless belt, a nip member, a heater and a rotary body. The nip plate may extend inside the endless belt, the nip plate having an end in an axial direction of the endless belt. The heater may extend inside the endless belt and may face the nip plate. The roller and the nip plate may be configured to nip the endless belt therebetween. The nip plate may include a protrusion protruding from the end of the nip plate in the axial direction toward the heater.

According to still another aspect of the present invention, there is provided a fixing device including an endless belt, a nip member, a heater and a rotary body. The endless belt may have one end and another end opposite to the one end in an axial direction of the endless belt, a first imaginary plane being defined as a plane passing through the another end and perpendicular to the axial direction and a second imaginary plane being defined as a plane passing through the one end and perpendicular to the axial direction. The nip plate and the heater may extend inside the endless belt. The rotary body and the nip plate may be configured to nip the endless belt therebetween. The nip plate may include a main portion and a protrusion protruding from the main portion toward an imaginary straight line that passes through the heater and is parallel to an axis of the endless belt, the protrusion being positioned opposite to the first imaginary plane with respect to the second imaginary plane.

DETAILED DESCRIPTION

Figure 1:
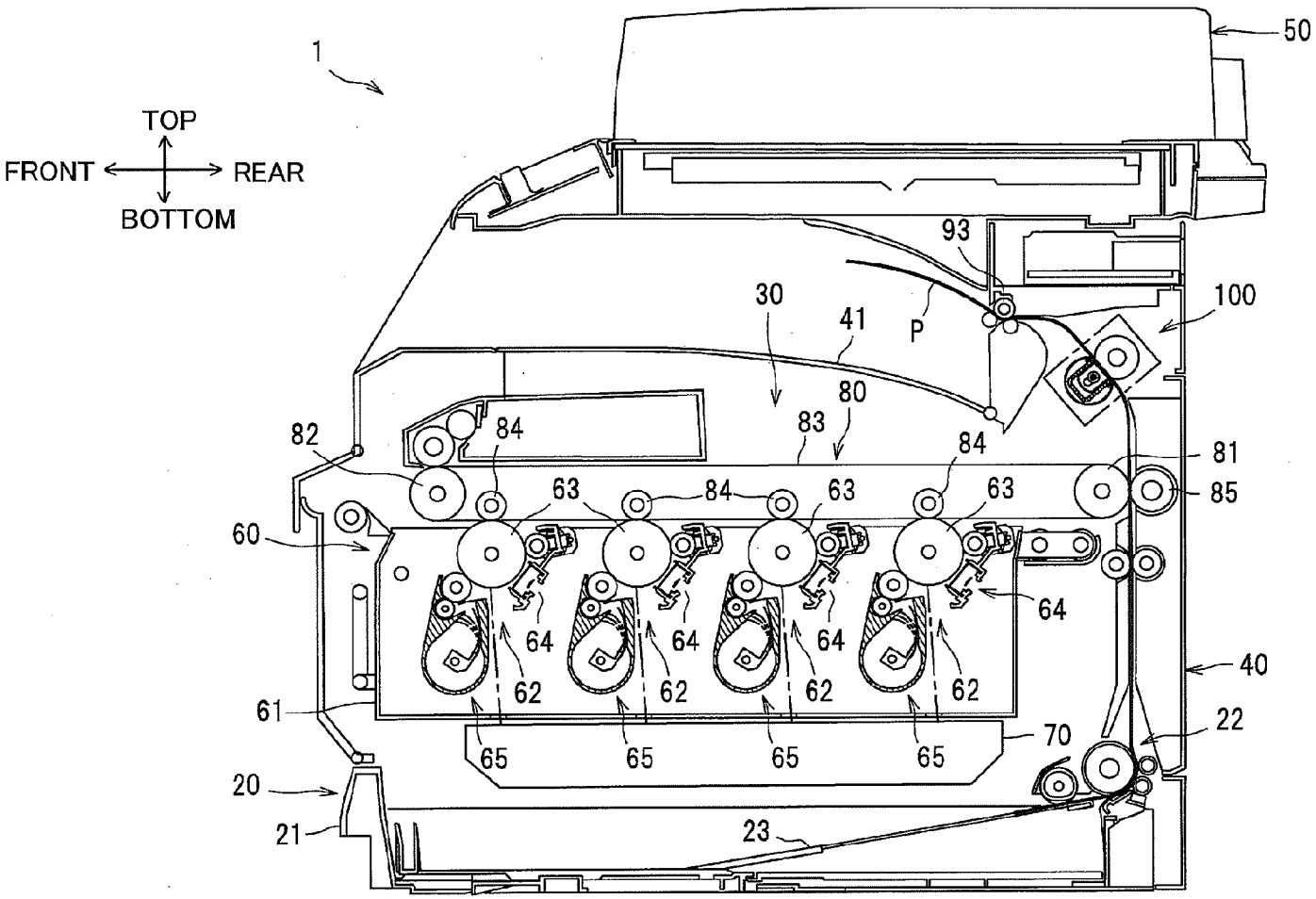
FIG. 1 is a schematic cross-sectional side view illustrating a general configuration of a color printer provided with a fixing device according to an embodiment of the present invention.

First, a general structure of a color printer 1 as an image forming device according to an embodiment of the present invention will be described with reference to FIG. 1. The color printer 1 shown in FIG. 1 is provided with a fixing device 100 according to the embodiment of the present invention. A detailed structure of the fixing device 100 will be described later with reference to FIGS. 2 through 7.

<General Structure of Laser Printer>

In FIG. 1, a right side, a left side, a near side and a far side will be referred to as a rear side, a front side, a right side and a left side of the color printer 1, respectively.

As shown in FIG. 1, the color printer 1 includes a main frame 40. Within the main frame 40, a sheet feeding unit 20 for feeding a sheet P, and an image forming unit 30 for forming an image on the sheet P are provided. The color printer 1 is also provided with a flat head scanner 50 disposed upward of the main frame 40. The image forming unit 30 includes a process unit 60, an exposure device 70, a transfer unit 80, and the fixing device 100.

The sheet feeding unit 20 is disposed at a lower portion of the main frame 40. The sheet feeding unit 20 includes a sheet tray 21 for accommodating the sheet P, a sheet feeding mechanism 22 disposed rearward of the sheet tray 21, and a lifter plate 23 for conveying the sheet P accommodated in the sheet tray 21 to the sheet feeding mechanism 22. The sheet P (rear end portion of the sheet P) accommodated in the sheet tray 21 is lifted upward by the lifter plate 32, separated one by one and conveyed upward by sheet feeding mechanism 22.

The process unit 60 includes a retaining case 61 and four process cartridges 62 accommodated in the retaining case 61. The four process cartridges 62 are juxtaposed in a front-rear direction at predetermined intervals.

Each process cartridge 62 includes a photosensitive drum 63, a charger 64, and a developing cartridge 65. The photosensitive drum 63 has a photosensitive layer as an outer peripheral surface. The charger 64 applies a uniform charge to the photosensitive layer of the photosensitive drum 63. The developing cartridge 65 is configured to supply developer to the photosensitive layer of the photosensitive drum 63. The photosensitive drum 63 is provided in an upper portion of the process cartridge 62. The charger 64 is disposed rearward of the photosensitive drum 63, and the developing cartridge 65 is disposed below the photosensitive drum 63.

In each process cartridge 62, after uniformly charged by the charger 64, the photosensitive layer of the photosensitive drum 63 is subjected to high speed scan of a laser beam emitted from the exposure device 70 (described next). An electrostatic latent image based on image data is thereby formed on the photosensitive layer of the photosensitive drum 63. Toner accommodated in the developing cartridge 65 is then supplied to the electrostatic latent image. Hence, the electrostatic latent image is developed into a visible toner image on the outer peripheral surface of the photosensitive drum 63.

The exposure device 70 is disposed above the sheet supply unit 20 and below the process unit 60 within the main frame 40. The exposure device 70 includes a laser source, a polygon mirror, lenses and reflection mirrors (all not shown). In the exposure device 70, the laser source emits a laser beam. The laser beam is reflected by or passes through the polygon mirror, the lenses, and the reflection mirrors such that the laser beam is irradiated on the outer peripheral surface of the photosensitive drum 63 at a high speed. The surface of a photosensitive drum 63 is thus exposed to light.

The transfer unit 80 is disposed upward of the process unit 60 within the main frame 40. The process unit 60 includes a drive roller 81, a follow roller 82 and an intermediate belt 83. The drive roller 81 is positioned above the sheet feeding mechanism 22. The follow roller 82 is disposed frontward of the drive roller 81 and is spaced away therefrom in the front-rear direction. The intermediate belt 83 is mounted (stretched) on and around the drive roller 81 and the follow roller 82.

The transfer unit 80 also includes four primary transfer rollers 84 and a secondary transfer roller 85. The primary transfer rollers 84 are disposed in an internal space of the intermediate belt 83 such that each primary transfer roller 84 opposes and is in pressure contact with each of the photosensitive drums 63 to nip a lower portion of the intermediate belt 83 therebetween. The secondary transfer roller 85 is disposed to oppose the drive roller 81 such that the secondary transfer roller 85 is pressed against the intermediate belt 83 from its rear side.

In the transfer unit 80, the toner image of each color formed on the surface of each photosensitive drum 63 is sequentially superimposed on the intermediate belt 83. The colored toner image superimposed on the intermediate belt 83 is then transferred onto the sheet P conveyed upward from the sheet feeding mechanism 22 while the sheet P is pressed against the intermediate belt 83 by the secondary transfer roller 85.

The fixing device 100 is disposed rearward of and upward of the transfer unit 80 within the main frame 40. The sheet P passing between the drive roller 81 and the secondary transfer roller 85 is conveyed upward to the fixing device 100, whereby the colored toner image transferred to the sheet P from the intermediate belt 83 is thermally fixed to the sheet P. The sheet P having the color image fixed thereto is finally discharged onto a discharge tray 41 by a discharge roller 93.

<Detailed Structure of Fixing Device>

Next, a detailed structure of the fixing device 100 according to the embodiment will be described with reference to FIGS. 2 through 7.

Figure 2:
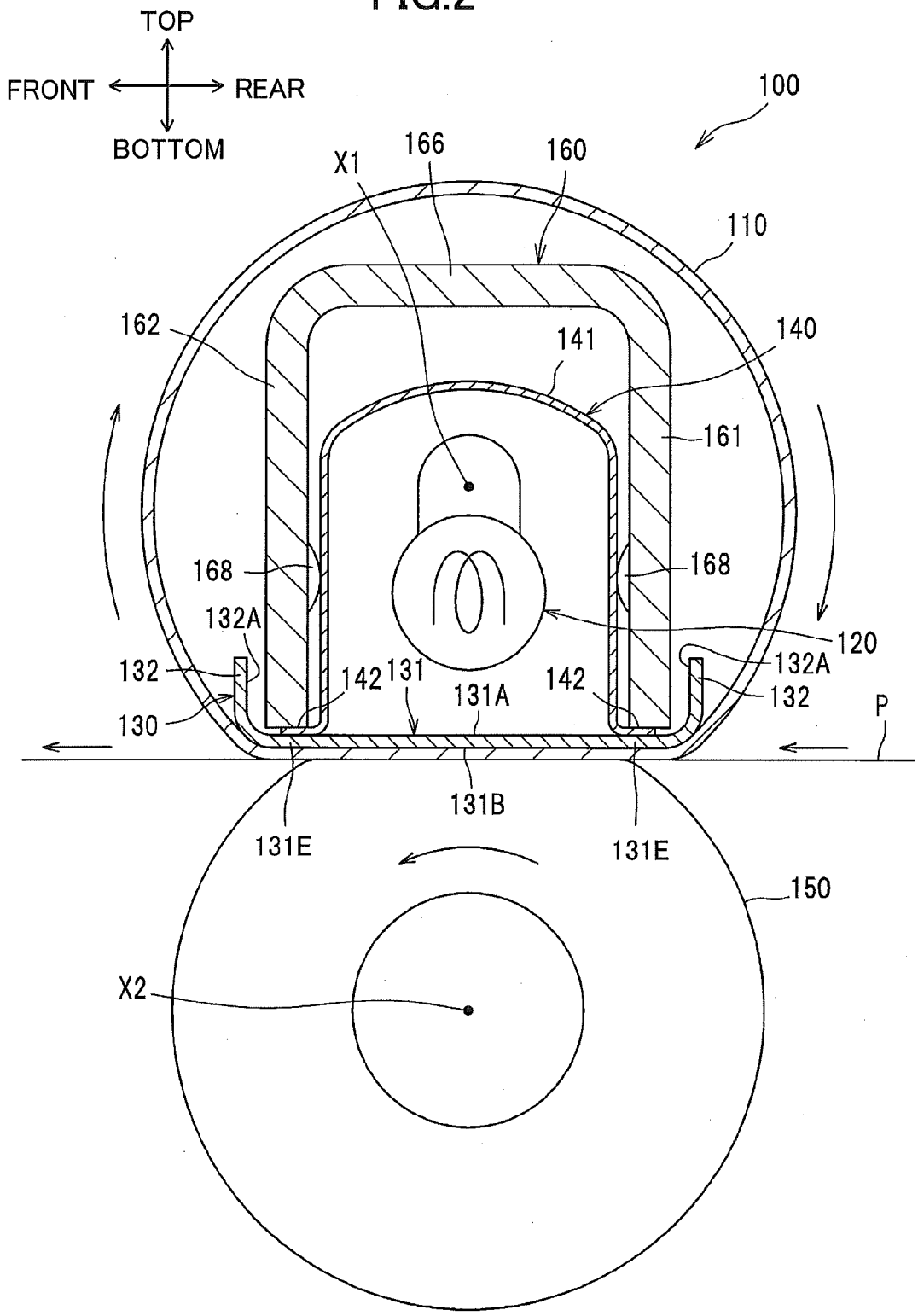
FIG. 2 is a schematic cross-sectional view illustrating a general configuration of the fixing device according to the embodiment, the fixing device including an endless belt and a nip plate.

In FIG. 2, a right side, a left side, a near side and a far side will be referred to as a rear side, a front side, a left side and a right side of the fixing device 100, respectively. Further, in FIG. 4, a left side, a right side, an upper-left side and a lower-right side will be referred to as a rear side, a front side, a left side and a right side of the fixing device 100, respectively.

As shown in FIG. 2, the fixing device 100 includes a flexible endless belt 110 for fusing, a halogen lamp 120, a nip plate 130, a reflection plate 140, a pressure roller 150 and a stay 160.

In the following description, a direction in which the sheet P is fed (a front-rear direction in the embodiment) will be referred to as a sheet feeding direction, which is shown as an arrow in FIG. 2.

The endless belt 110 is of an endless belt (of a tubular configuration) having heat resistivity and flexibility. The endless belt 110 has an inner peripheral surface that defines an internal space for accommodating the halogen lamp 120, the nip plate 130, the reflection plate 140 and the stay 160. The endless belt 110 defines a first axis X1 (hereinafter to be referred to as an "imaginary axis X1") extending in an imaginary axial direction D1 (left-right direction in the embodiment or longitudinal direction) about which the endless belt 110 is circularly movable. The imaginary axis X1 (imaginary axial direction D1) is perpendicular to the sheet feeding direction. Movement of the endless belt 110 in the imaginary axial direction D1 (left-right direction) is guided (restricted) by restricting members (not shown in drawings).

Figure 3:
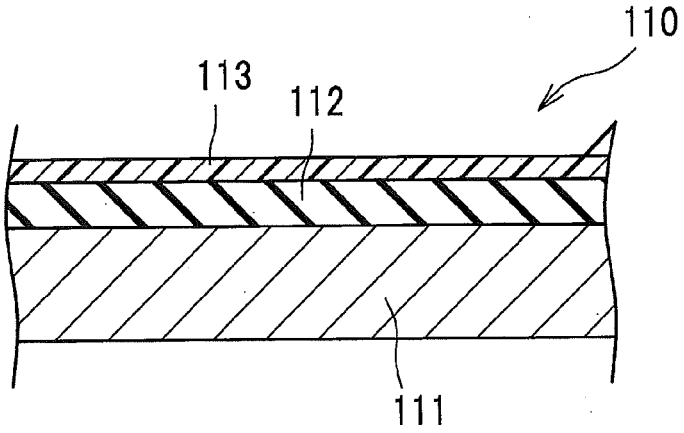
FIG. 3 is a partially-enlarged cross-sectional view showing a layered structure of the endless belt of the embodiment.

Specifically, the endless belt 110 is configured of a base layer 111, a rubber layer 112 as an intermediate layer, and a fluorine resin layer 113 as an outermost layer, as shown in FIG. 3. The base layer 111 has an outer surface covered by the rubber layer 112. The rubber layer 112 has an outer surface covered with the fluorine resin layer 113. The base layer 111 may be made of a resin or a metal.

Figure 4:
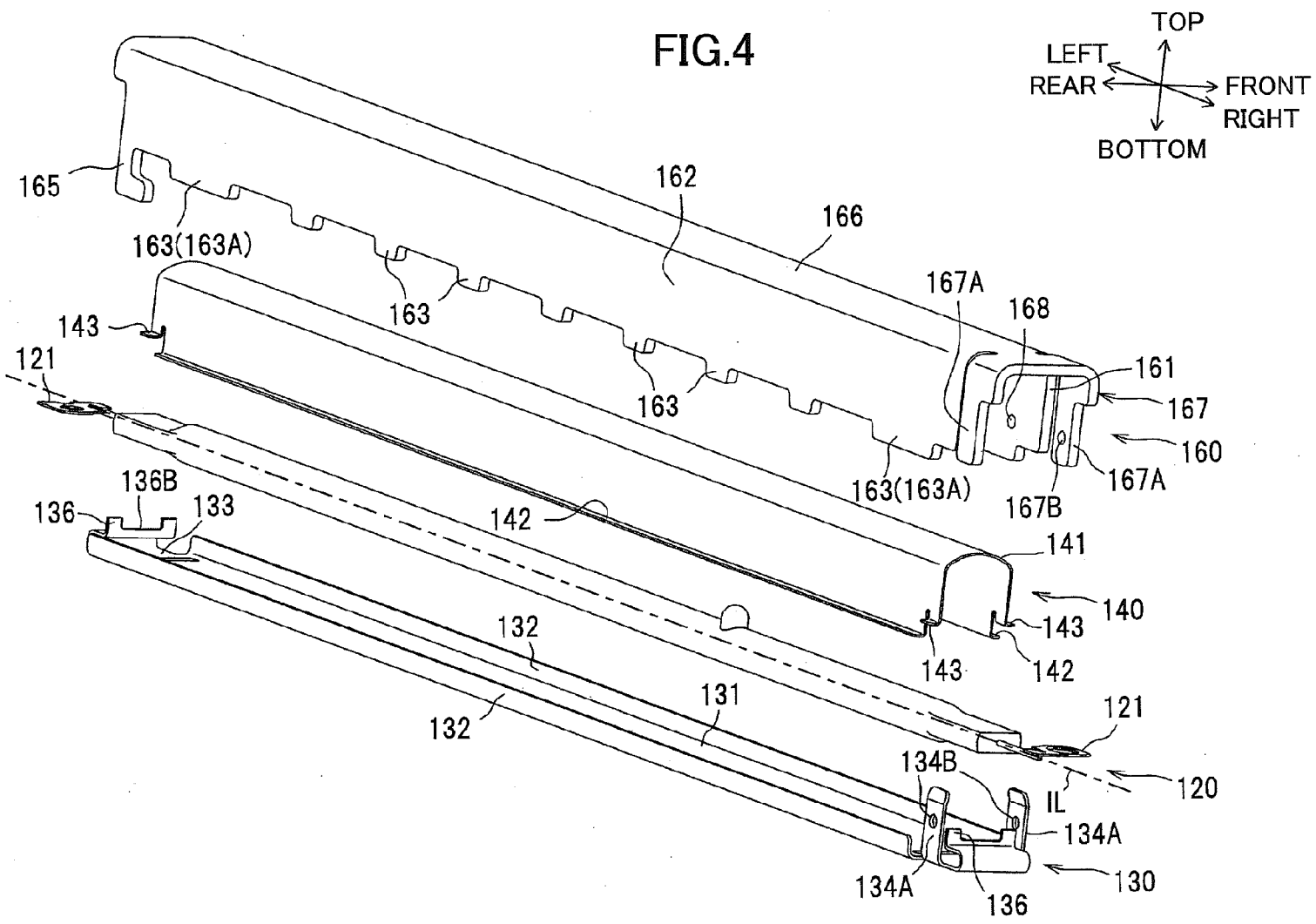
FIG. 4 is an exploded perspective view of components constituting the fixing device according to the embodiment.

The halogen lamp 120 is a well-known heater configured to emit radiant heat to heat the nip plate 130 and the endless belt 110 for heating toner on the sheet P. The halogen lamp 120 is positioned at the internal space of the endless belt 110 and extends through the internal space in a direction parallel to the imaginary axis X1. The halogen lamp 120 is positioned to be spaced away from the inner peripheral surface of the endless belt 110 and an upper surface 131A (described next) of the nip plate 130 respectively by a predetermined distance. As shown in FIG. 4, an electrical terminal 121 is provided to extend outward from each longitudinal end of a main body portion of the halogen lamp 120.

The nip plate 130 is disposed to extend through the internal space. The nip plate 130 has a plate shape extending in the left-right direction (longitudinal direction). The nip plate 130 is configured to contact the inner peripheral surface of the endless belt 110. The nip plate 130 is adapted for receiving radiant heat from the halogen lamp 120 and for transmitting the radiant heat to the toner on the sheet P through the endless belt 110.

The nip plate 130 has a generally flat U-shaped cross-section taken along a plane perpendicular to the longitudinal direction of the nip plate 130. The nip plate 130 is made from a material such as aluminum having a thermal conductivity higher than that of the stay 160 (described later) made from steel. More specifically, for fabricating the nip plate 130, an aluminum plate is bent into a flat U-shape to provide a base portion 131 and upwardly folded side wall portions 132.

The base portion 131 has the upper surface (inner surface) 131A and a lower surface 131B opposite to the upper surface 131A. The upper surface 131A faces the halogen lamp 120 to receive radiant heat therefrom (see FIG. 2). The upper surface 131A may be painted with black color or provided with a heat absorbing member to effectively receive radiant heat from the halogen lamp 120.

As shown in FIG. 2, the lower surface 131B of the base portion 131 is configured to be in sliding contact with the inner peripheral surface of the endless belt 110. The lower surface 131B may be covered with an oxide layer or a fluorine resin coating layer.

The base portion 131 is flat and extends in the left-right direction. The base portion 131 has a width (front-rear dimension) in the sheet feeding direction. In the embodiment, the sheet feeding direction is coincident with the front-rear direction of the nip plate 130. The base portion 131 has front and rear end portions 131E (see FIG. 2). The side wall portions 132 extend upward respectively from the front and rear end portions 131E of the base portion 131. The side wall portions 132 have inner surfaces 132A (see FIG. 2) that may be painted with black color or provided with a heat absorbing member to effectively receive radiant heat from the halogen lamp 120, just as the upper surface 131A.

As shown in FIG. 4, the base portion 131 has a left end portion (one longitudinal end) provided with an insertion portion 133, and a right end portion (another longitudinal end) provided with an engagement portion 134. The engagement portion 134 has a U-shaped configuration as viewed from its right side and includes front and rear wall portions 134A extending upward. Each of the front and rear wall portions 134A is formed with an engagement hole 134B.

The reflection plate 140 configured into U-shape in cross-section. The reflection plate 140 has a U-shaped reflection portion 141 and a flange portion 142 extending from each end portion of the reflection portion 141 in the sheet feeding direction.

Figure 5:
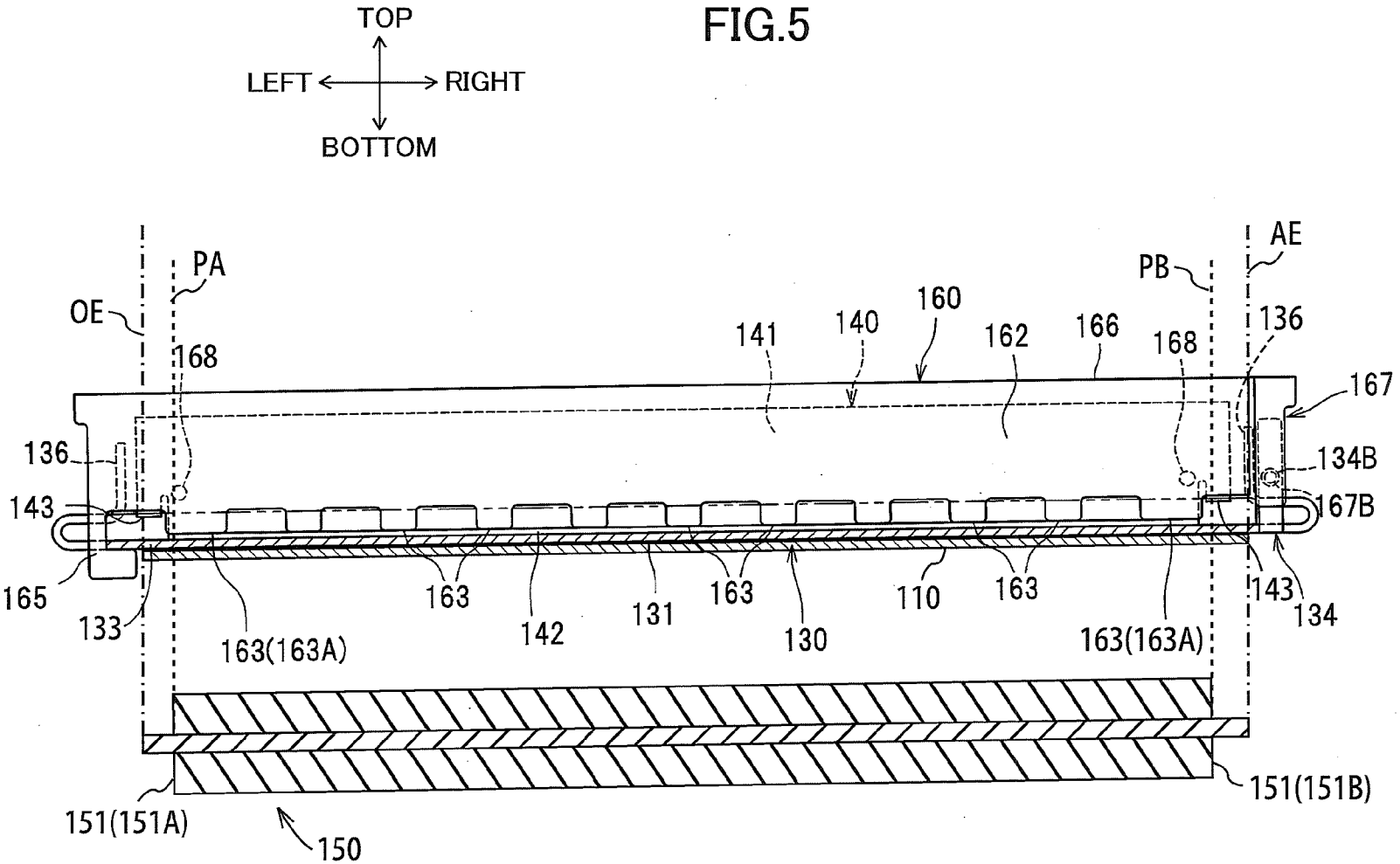
FIG. 5 is a rear side view illustrating an assembled state of the components of the fixing device according to the embodiment.

As shown in FIG. 4, two engagement sections 143 are formed at each longitudinal end of the reflection plate 140 (only three of four engagement sections 143 are shown in FIG. 4). Each engagement section 143 is positioned higher than the flange portion 142. As a result of assembly of the nip plate 130 together with the reflection plate 140 and the stay 160 as shown in FIG. 5, comb-like contact portions 163 (163A) of the stay 160 described later are interposed between the right and left engagement sections 143. That is, the right engagement section 143 is in contact with the rightmost contact portion 163A, and the left engagement section 143 is in contact with the leftmost contact portion 163A.

The pressure roller 150 is formed of an elastically deformable material. The pressure roller 150 is positioned below the nip plate 130, as shown in FIG. 2. In an elastically deformed state, the pressure roller 150 nips the endless belt 110 in cooperation with the nip plate 130 to provide a nip region for nipping the sheet P between the pressure roller 150 and the endless belt 110. To provide the nip region, a biasing member, such as a coil spring, may be provided to bias the pressure roller 150 toward the nip plate 130 or vice versa.

The pressure roller 150 is driven by a motor (not shown) disposed in the main frame 40 to rotate about a second axis X2 (hereinafter, to be referred to as an "imaginary axis X2" as shown in FIG. 2) generally parallel to the imaginary axis X1 (first axis X1) of the endless belt 110. By the rotation of the pressure roller 150 about the imaginary axis X2, the endless belt 110 is caused to circularly move about the imaginary axis X1 because of a frictional force generated between the pressure roller 150 and the sheet P, and between the sheet P and the endless belt 110. The toner image on the sheet P can be thermally fixed thereon by heat and pressure during passage of the sheet P at the nip region between the pressure roller 150 and the endless belt 110.

The stay 160 is adapted to support the front and rear end portions 131E of the nip plate 130 via the flange portions 142 of the reflection plate 140 for maintaining rigidity of the nip plate 130. The stay 160 has a U-shape configuration in conformity with an outer profile of the reflection plate 140 (reflection portion 141) for covering the reflection plate 140. For fabricating the stay 160, a highly rigid member such as a steel plate is folded into U-shape to provide a top wall 166, a front wall 161 and a rear wall 162.

As shown in FIG. 3, each of the front wall 161 and the rear wall 162 has a lower end portion formed with comb-like contact portions 163.

The front and rear walls 161, 162 have left end portions provided with L-shaped engagement legs 165 each extending downward and then leftward. The top wall 166 has a right end portion provided with a retainer 167 having U-shaped configuration in a right side view. The retainer 167 has a pair of retaining walls 167A each of whose inner surfaces is provided with an engagement boss 167B protruding inward (only one engagement boss 167B is shown in FIG. 4).

As shown in FIGS. 2 and 4, each of the front wall 161 and the rear wall 162 has longitudinal end portions whose inner surfaces are each provided with an abutment boss 168 protruding inward therefrom. The abutment bosses 168 are in abutment with an outer surface of the reflection portion 141 (see FIG. 2). Therefore, displacement of the reflection plate 140 in the sheet feeding direction due to vibration caused by operation of the fixing device 100 can be restrained because of the abutment of the reflection portion 141 with the bosses 168.

Assembling procedure of the reflection plate 140 and the nip plate 130 to the stay 160 will now be described.

First, the reflection plate 140 is coupled to the stay 160. The reflection plate 140 is temporarily assembled to the stay 160 by the abutment of the outer surface of the reflection portion 141 on the abutment bosses 168. At this time, the engagement sections 143 are brought into contact with the outermost contact portions 163A in the longitudinal direction.

Then, as shown in FIG. 5, the insertion portion 133 of the nip plate 130 is inserted between the engagement legs 165, 165, so that the base portion 131 (both end portions 131E) are brought into engagement with the engagement legs 165, 165. Thereafter, the engagement bosses 167B of the retainer 167 are engaged with the corresponding engagement holes 134B of the engagement portion 134 of the nip plate 130. By this engagement of the both end portions 131E with the engagement legs 165 and the engagement of the engagement portion 134 with the retainer 167, the nip plate 130 is held to the stay 160. Also, the reflection plate 140 is held to the stay 60 such that each flange portion 142 of the reflection plate 140 is sandwiched between the nip plate 130 (each end portion 131E) and the stay 160. The nip plate 130 and the reflection plate 140 are thus held to the stay 160.

Here, referring to FIGS. 4 to 7, the left end portion (longitudinal end portion) of the base portion 131 of the nip plate 130 is folded upward to provide a protruding portion 136 (as an example of a protrusion) and a bent portion 135. In other words, the protruding portion 136 and the bent portion 135 are integrally formed with the insertion portion 133. Put another way, the protruding portion 136 is in continuous with the insertion portion 133 via the bent portion 135.

The bent portion 135 extends leftward from the insertion portion 133 and is then folded rightward to cover the insertion portion 133 from above. Thus, the bent portion 135 has a generally U-shape in a side view. The protruding portion 136 extends generally vertically upward from the bent portion 135 to be positioned above the insertion portion 133. In other words, the protruding portion 136 extends in a direction perpendicular to the longitudinal direction of the base portion 131.

Figure 6:
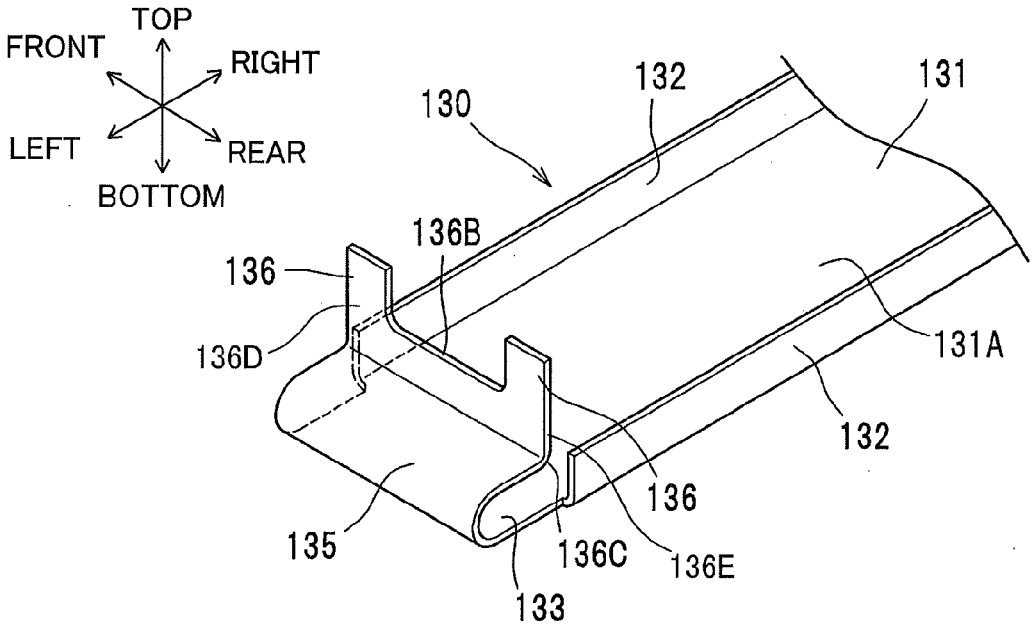
FIG. 6 is an enlarged perspective view of a left end portion (one longitudinal end portion) of the nip plate according to the embodiment.

The protruding portion 136 has a generally flat first surface 136A (right surface) opposing the main body portion of the halogen lamp 120 in the left-right direction so that the first surface 136A can receive radiant heat from the halogen lamp 120. The protruding portion 136 also has a second surface 136D opposite to the first surface 136A, and an end face 136E connecting between the first surface 136A and the second surface 136D. As shown in FIG. 6, the end face 136E has an area smaller than an area of the first surface 136A and an area of the second surface 136D.

Figure 7:
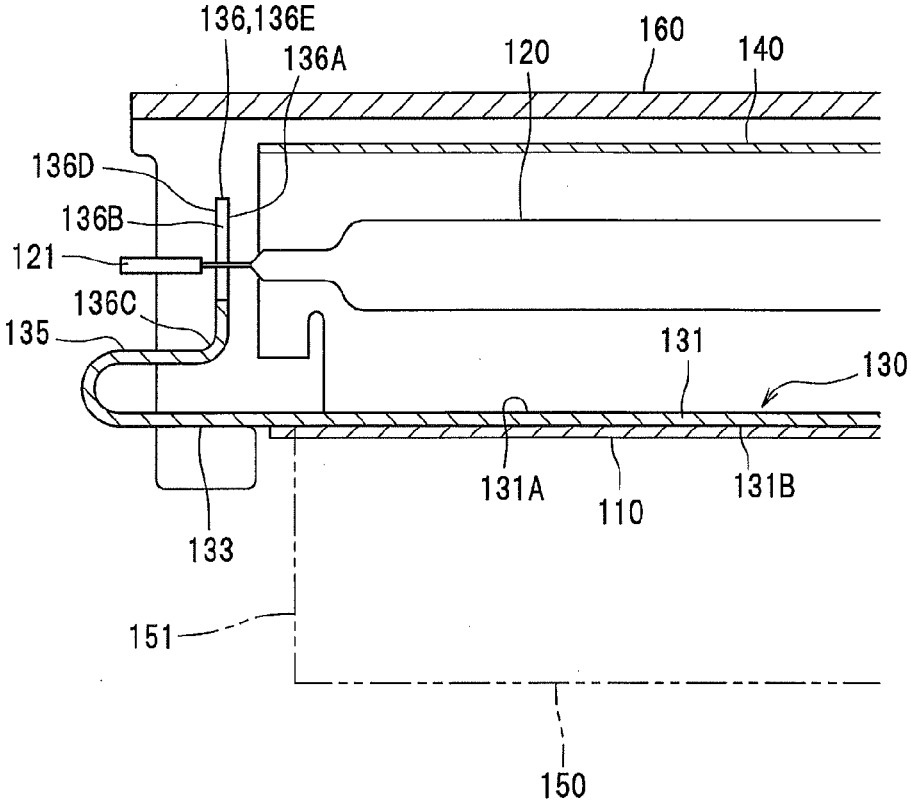
FIG. 7 is a partially-enlarged cross-sectional view showing a structure of a left end portion of the fixing device according to the embodiment.

The protruding portion 136 has an upper end in which a recessed portion 136B is formed. The recessed portion 136B has a flat U-shape opening upward in a side view. As shown in FIG. 7, a component near the electrical terminal 121 of the halogen lamp 120 is positioned to be received within the recessed portion 136B in an assembled state. Although not shown in FIG. 7, the electrical terminals 121 of the halogen lamp 120 are fixed to the restricting members of the fixing device 100.

The protruding portion 136 and the bent portion 135 are also formed at the right end portion (another longitudinal end portion) of the base portion 131 of the nip plate 130, i.e., rightward of the engagement portion 134.

As shown in FIG. 7, the protruding portion 136 has a base end 136C (the end connected to the bent portion 135) that is positioned outward of an end face 151 of the pressure roller 150 in a direction parallel to the imaginary axis X2 of the pressure roller 150. In other words, the base end 136C of the protruding portion 136 is positioned outward of the end face 151 of the pressure roller 150 in the imaginary axial direction D1 generally parallel to the imaginary axis X2. With this structure, the base portion 131 of the nip plate 130 can be in contact with an entire left-right dimension of the pressure roller 150 via the endless belt 110, thereby ensuring that an entire left-right dimension (width) of the sheet P can be sufficiently heated.

Further referring to FIG. 5, positional relationship between the pressure roller 150 and the nip plate 130 with respect to the left-right direction is described in detail. Here, assume that an imaginary plate AE is a plane passing through (aligned with) a right endface of the endless belt 110 and perpendicular to the imaginary axial direction D1, and an imaginary plate OE is a plane passing through (aligned with) a left endface of the endless belt 110 and perpendicular to the imaginary axial direction D1. Also assume that an imaginary plane PA is a plane passing through (aligned with) the end face 151 (left end face 151A) of the pressure roller 150, and an imaginary plane PB is a plane passing through (aligned with) the end face 151 (right end face 151B) of the pressure roller 150. As illustrated in FIG. 5, the protruding portion 136 on the left is positioned outward (leftward) of the imaginary plane PA in the imaginary axial direction D1. Likewise, the protruding portion 136 on the right is positioned outward (rightward) of the imaginary plane PB in the imaginary axial direction D1. Put another way, the protruding portion 136 is positioned opposite to the imaginary plane AE with respect to the imaginary plane OE. Further, referring to FIG. 4, assume that an imaginary straight line IL is a straight line that passes through the halogen lamp 120 and is parallel to the imaginary axial direction D1.

In the fixing device 100 of the depicted embodiment, a toner image is thermally fixed to the sheet P while the sheet P passes the nip region, i.e., between the pressure roller 150 rotating about the imaginary axis X2 and the endless belt 110 heated by the nip plate 130 and circularly moving about the imaginary axis X1.

The endless belt 110 of the present embodiment includes the rubber layer 112 as shown in FIG. 3. Therefore, compared to an endless belt without a rubber layer, heat conductivity of the endless belt 110 is suppressed relatively low and thus heat is hard to be transmitted from the base portion 131 of the nip plate 130 to the endless belt 110.

However, the base portion 131 of the nip plate 130 of the present embodiment is provided with the protruding portions 136 at the both longitudinal ends. Since the protruding portion 136 has the flat first surface 136A opposing the halogen lamp 120, radiant heat from the halogen lamp 120 can be transmitted from the first surface 136A to the longitudinal ends of the base portion 131 via the bent portion 135 and the insertion portion 133 (or the engagement portion 134). With this structure, the base portion 131 of the nip plate 130 can be heated sufficiently across an entire longitudinal dimension thereof by radiant heat from the halogen lamp 120.

Further, heat capacity of the nip plate 130 increases with provision of the protruding portion 136 and the bent portion 135, since the mass of the nip plate 130 increases by the mass of the protruding portion 136 and the bent portion 135. As a result, the base portion 131 of the nip plate 130 as a whole in the longitudinal direction can transmit sufficient heat to the sheet P (across the entire width of the sheet P) via the endless belt 110, thereby preventing insufficient thermal fixation on the sheet P that tends to occur on widthwise ends of the sheet P.

Further, end components of the halogen lamp 120 (components near the electrical terminals 121 of the halogen lamp 120) are disposed to be received in the corresponding recessed portions 136B. Therefore, interference between the end components of the halogen lamp 120 and the protruding portions 136 can be prevented at the time of assembly of the fixing device 100. Assembly of the fixing device 100 can be thus facilitated.

Further, since the end components of the halogen lamp 120 are received in respective recessed portions 136B, the protruding portions 136 can positioned even closer to the halogen lamp 120, leading to increase in heat capacity and increase in amount of heat received at the protruding portion 136.

As described above, with the structure of the fixing device 100 of the present embodiment, entirety of the sheet P can be heated sufficiently with respect to its widthwise direction by entirety of the base portion 131 of the nip plate 130 spanning in the longitudinal direction. As a result, insufficient thermal fixation can be prevented from occurring at widthwise ends of the sheet P. Further, interference between the end components of the halogen lamp 120 and the protruding portions 136 at the time of assembly can be prevented, which facilitates assembly of the fixing device 100.

In the described embodiment, the end components of the halogen lamp 120 are completely disposed (received) within the recessed portion 136B. However, if the end components of the halogen lamp 120 have a vertical dimension higher than that shown in FIG. 7, the end components may partially protrude higher than the recessed portion 136B.

Various modifications are conceivable.

Hereinafter, first to fifth modifications to the above-described embodiment will be described with reference to FIGS. 8 through 12, wherein like parts and components are designated by the same reference numerals with those of the depicted embodiment to avoid duplicating description.

Figure 8:
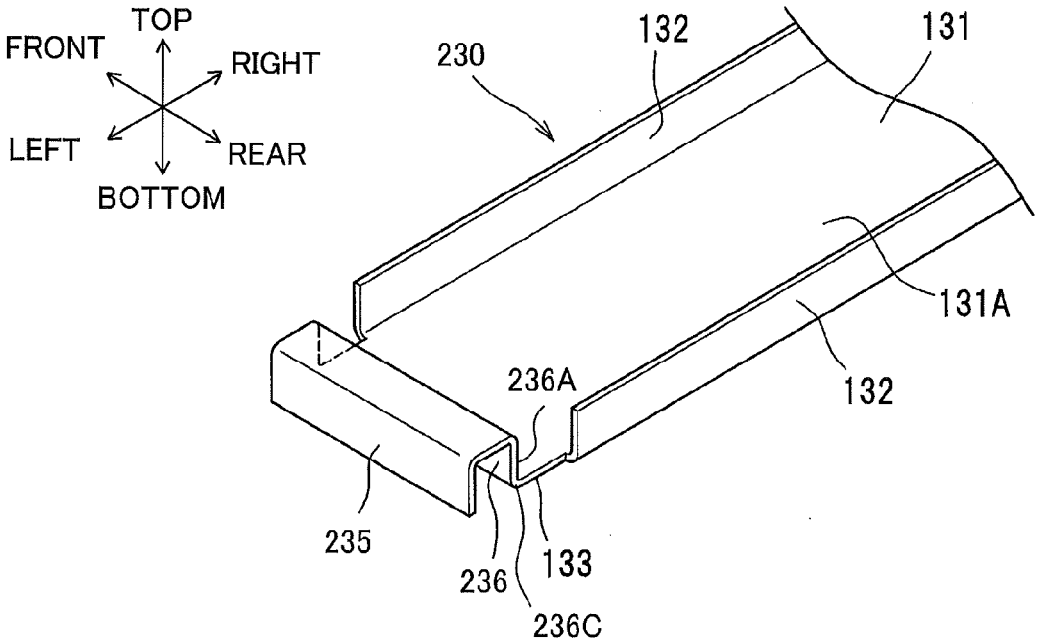
FIG. 8 is a partially-enlarged perspective view showing a left end portion (one longitudinal end portion) of a nip plate according to a first modification to the embodiment.

FIG. 8 shows a nip plate 230 according to a first modification to the depicted embodiment.

In the first modification, the protruding portion 136 and the bent portion 135 of the embodiment are replaced with a protruding portion 236 and a bent portion 235.

Specifically, the nip plate 230 of the first modification has both longitudinal end portions each formed with the protruding portion 236 and the bent portion 235. In FIG. 8, only left end portion of the base portion 131 of the nip plate 230 is shown for explanatory purpose.

The protruding portion 236 is flat plate shaped. The protruding portion 236 has a base end 236C extending upward from a left end of the insertion portion 133, and a tip end connected to the bent portion 235. The bent portion 235 extends leftward from the tip end of the protruding portion 236 and has a generally L-shaped cross section. Thus, the protruding portion 236 and the bent portion 235 together form a generally inverted U-shape in cross section when viewed in the front-rear direction.

The protruding portion 236 has a generally flat inner wall 236A opposing the main body portion of the halogen lamp 120 in the left-right direction. Thus this inner wall 236A (first wall 236A) serves to receive radiant heat from the halogen lamp 120, just like the first surface 136A of the embodiment.

Here, in the first modification, a lower surface of the base portion 131 of the nip plate 230 may be coated with a fluorine resin having heat resistivity, since the lower surface is configured to be in sliding contact with the inner peripheral surface of the endless belt 110.

Figure 9:
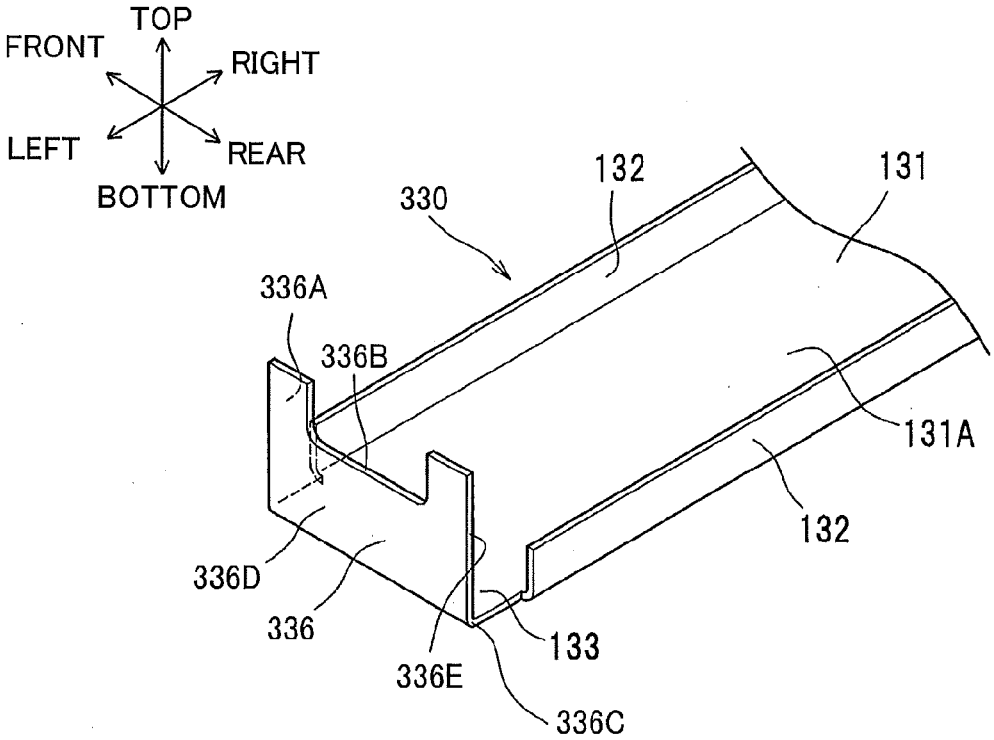
FIG. 9 is a partially-enlarged perspective view showing a left end portion (one longitudinal end portion) of a nip plate according to a second modification to the embodiment.

FIG. 9 shows a nip plate 330 according to a second modification to the depicted embodiment.

In the second modification, the bent portion 135 of the embodiment is dispensed with.

Specifically, the nip plate 330 of the second modification has both longitudinal end portions each formed with a protruding portion 336. In FIG. 9, only left end portion of the base portion 131 of the nip plate 330 is shown for explanatory purpose.

The protruding portion 336 is flat plate shaped. The protruding portion 336 has a base end 336C extending upward from the insertion portion 133 and an upper end portion formed with a recessed portion 336B. The recessed portion 336B has the same flat U-like shape as the recessed portion 136B of the embodiment.

The protruding portion 336 has a generally flat first surface 336A (inner surface) opposing the main body portion of the halogen lamp 120, a second surface 336D opposite to the first surface 336A, and an end face 336E connecting between the first surface 336A and the second surface 336D. The protruding portion 336 stands upright and extends upward in FIG. 9, i.e., in a direction perpendicular to the longitudinal direction of the base portion 131.

The recessed portion 336B of the second modification may be in a form of a through-hole penetrating the protruding portion 336 in the left-right direction.

Figure 10:
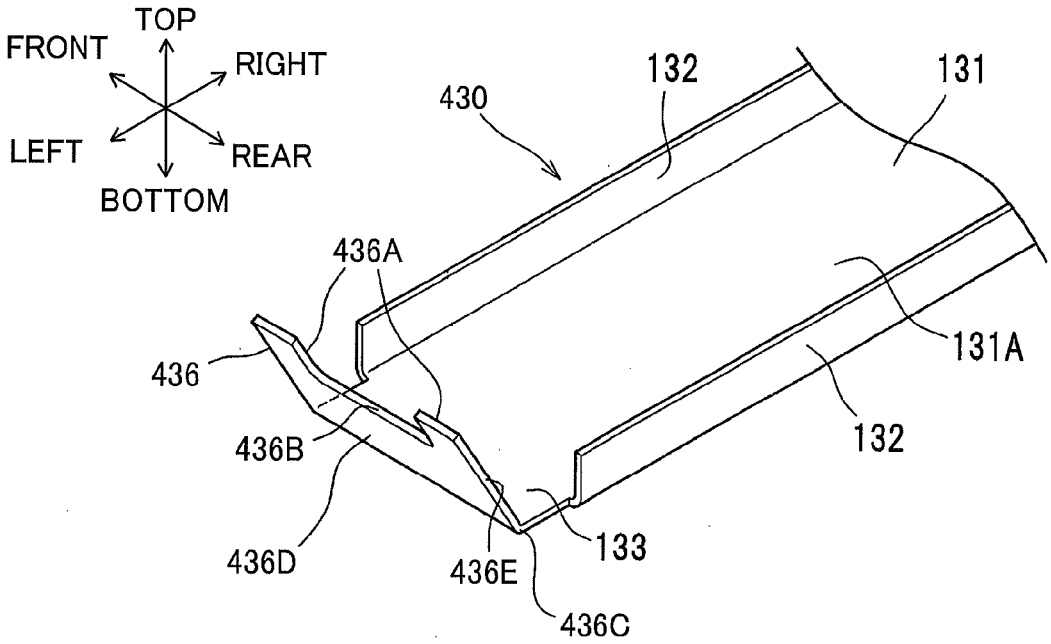
FIG. 10 is a partially-enlarged perspective view showing a left end portion (one longitudinal end portion) of a nip plate according to a third modification to the embodiment.

FIG. 10 shows a nip plate 430 according to a third modification to the depicted embodiment.

In the third modification, the bent portion 135 of the embodiment is dispensed with, as in the second modification.

Specifically, the nip plate 430 of the third modification has both longitudinal end portions each formed with a protruding portion 436. In FIG. 10, only left end portion of the base portion 131 of the nip plate 430 is shown for explanatory purpose.

The protruding portion 436 is flat plate shaped and has a substantially similar configuration with the protruding portion 336 of the second modification. Specifically, the protruding portion 436 has a base end 436C extending from the insertion portion 133, an upper end portion formed with a recessed portion 436B, a generally flat first surface 436A opposing the main body portion of the halogen lamp 120, a second surface 436D opposite to the first surface 436A, and an end face 436E connecting between the first surface 436A and the second surface 436D.

The protruding portion 436 extends diagonally upward and outward from the insertion portion 133. The first surface 436A of the protruding portion 436 may form an angle (acute angle) smaller than 45 degrees relative to a vertical plane (not shown) perpendicular to the longitudinal direction of the base portion 131 of the nip plate 430.

The protruding portion 436 of the third modification may be slanted relative to the insertion portion 133 such that the protruding portion 436 (first surface 436A) extends away from the main body of the halogen lamp 120 toward the upper end portion of the protruding portion 436. Such slanted provision of the protruding portion 436 relative to the insertion portion 133 can increase an amount of radiant heat received from the halogen lamp 120, compared to a case where a protruding portion tilts inward in the left-right direction.

The recessed portion 436B of the third modification may be in a form of a through-hole penetrating the protruding portion 436 in the left-right direction.

Figure 11:
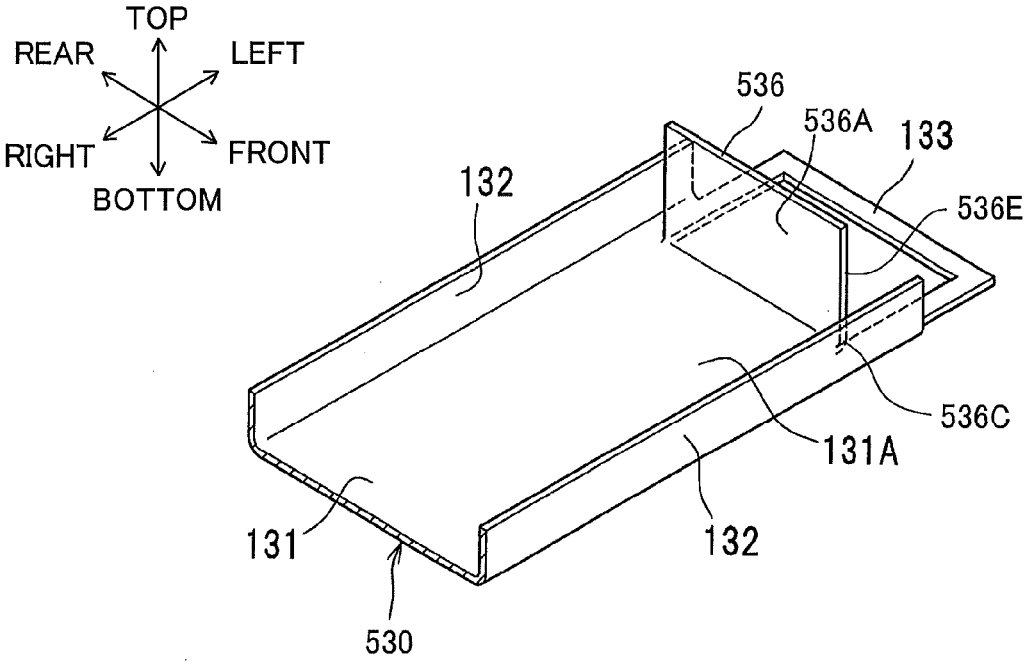
FIG. 11 is a partially-enlarged perspective view showing a left end portion (one longitudinal end portion) of a nip plate according to a fourth modification to the embodiment.

FIG. 11 shows a nip plate 530 according to a fourth modification to the depicted embodiment.

The nip plate 530 of the fourth modification has both longitudinal end portions each formed with a protruding portion 536. In FIG. 11, only left end portion of the base portion 131 of the nip plate 530 is shown for explanatory purpose.

The protruding portion 536 is flat plate shaped. The protruding portion 536 originally occupies a portion spanning between the base portion 131 and the insertion portion 133. This portion is cut and bent upward to extend generally vertically such that the protruding portion 536 extends upward from the base portion 131 but is separated from the insertion portion 133. In other words, the protruding portion 536 has a base end 536C extending upward from the base portion 131, not from the insertion portion 133. The protruding portion 536 has a generally flat inner surface (first surface) 536A opposing the main body portion of the halogen lamp 120 to receive radiant heat from the halogen lamp 120. The protruding portion 536 also has a second surface 536D opposite the first surface 536A, and an end face 536E connecting the first surface 536A and the second surface 536D.

Figure 12:
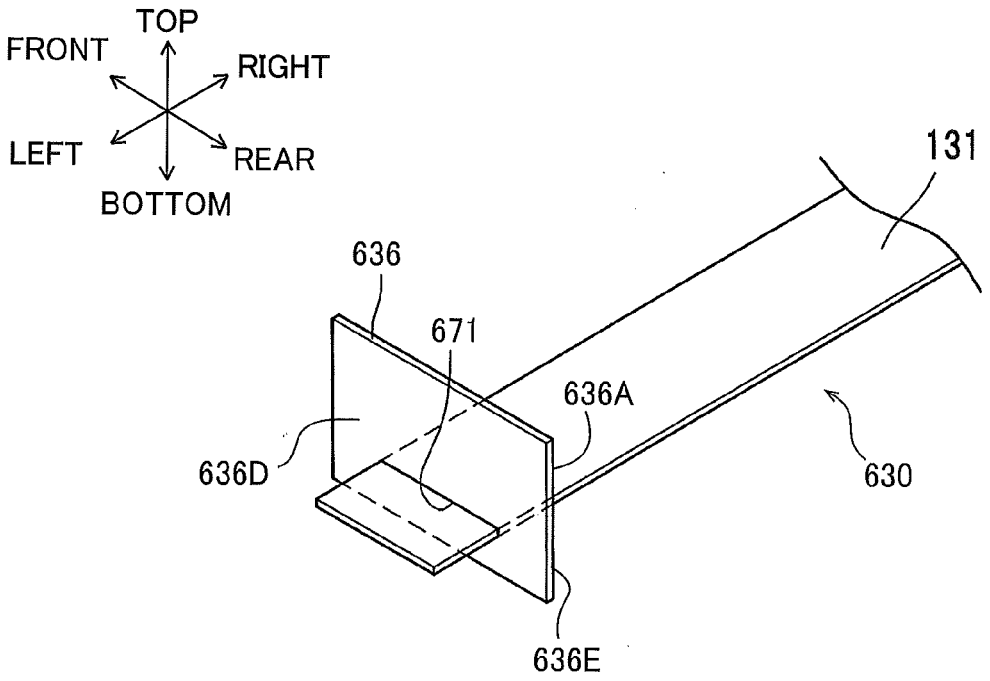
FIG. 12 is a partially-enlarged perspective view showing a left end portion (one longitudinal end portion) of a nip plate according to a fifth modification to the embodiment.

FIG. 12 shows a nip plate 630 according to a fifth modification to the depicted embodiment.

The nip plate 630 of the fifth modification has both longitudinal end portions each formed with a protruding portion 636. In FIG. 12, only left end portion of the base portion 131 of the nip plate 630 is shown for explanatory purpose. Further, in FIG. 12, the side wall portions 132 and the insertion portion 133 of the nip plate 630 are omitted for simplifying explanation.

The protruding portion 636 is a flat, rectangular shaped plate-like shaped member. The protruding portion 636 is formed with a slit 671 extending in the front-rear direction. The longitudinal end portion of the base portion 131 is inserted into and press-fitted to the slit 671 such that the protruding portion 636 is generally perpendicular to the base portion 131. The protruding portion 636 thus extends vertically upward from the base portion 131.

In the nip plate 630 of the fifth modification produced as above, the protruding portion 636 has an inner surface 636A (first surface 636A) configured to receive radiant heat from the halogen lamp 120, a second surface 636D opposite the first surface 636A and an end face 636E connecting between the first surface 636A and the second surface 636D.

Just like the protruding portion 636 of the fifth modification, the claimed protruding portion may be formed as a separate member from the claimed main portion (base portion 131 in the embodiment). If this is the case, such protruding portion may be bonded to the main portion by an adhesive agent with heat resistance, or by screws. Alternatively, the claimed nip member may be made from a single plate produced by rolling or by machining.

In the present invention, the claimed nip member is "integrally formed" as a metal member not only means that the claimed main portion (metal) and the claimed protruding portion (metal) are integrally formed by folding a single metal material, but also means that the claimed main portion (metal) and the claimed protruding portion (metal) are combined into a single metal member by welding or blazing. However, "integrally formed" in the present invention excludes integration of the claimed main portion (metal) and the claimed protruding portion (metal) by a non-metal adhesive agent.

Instead of the endless belt 110 of the embodiment having three-layered structure, a single-layered endless belt configured solely of the base layer 111 (see FIG. 3) may also be available. Further, the endless belt 110 of the embodiment may or may not have a seam.

It should be noted that in the fixing device 100 of the present invention, "contact with the inner peripheral surface of the endless belt 110" may include both "direct contact" with the inner peripheral surface and "indirect contact" with the inner peripheral surface via other layer-shaped member.

While the invention has been described in detail with reference to the embodiments thereof, it would be apparent to those skilled in the art that various changes and modifications may be made therein without departing from the spirit of the invention.

What is claimed is:

1. A fixing device comprising:

an endless belt having an inner peripheral surface defining an internal space, the endless belt being configured to circularly move;

a nip member extending through the internal space;

a heater extending through the internal space; and a rotary body defining an axis extending in an axial direction and disposed to be opposite to the heater with respect to the nip member, the rotary body and the nip member being configured to nip the endless belt therebetween, wherein the nip member comprises:

a main portion extending in the axial direction and having a first axial end portion; and a protruding portion protruding from the first axial end portion of the main portion toward the heater, the protruding portion having a first surface configured to receive radiant heat from the heater, the first surface being a generally flat surface, the protruding portion having a base end connected to the first axial end portion and a distal end opposite to the base end, the first surface being slanted relative to the main portion such that the first surface extends outward in the axial direction toward the distal end.

2. The fixing device as claimed in claim 1, wherein the main portion and the protruding portion comprise metal.

3. The fixing device as claimed in claim 2, wherein the base end of the protruding portion is integrally formed with the first axial end portion of the main portion.

4. The fixing device as claimed in claim 1, wherein the main portion and the protruding portion comprise a metal plate.

5. The fixing device as claimed in claim 4, wherein the protruding portion further comprises a second surface opposite the first surface and an end face connecting the first surface and the second surface, the end face having an area smaller than an area of the first surface and than an area of the second surface.

6. The fixing device as claimed in claim 1, wherein the first axial end portion of the main portion has a first end in the axial direction, the protruding portion protruding from the first end of the first axial end portion of the main portion.

7. The fixing device as claimed in claim 1, wherein the rotary body extends in the axial direction and has an end face in the axial direction; and wherein the base end of the protruding portion is integrally formed with the first axial end portion of the main portion, the base end being positioned outward of the end face of the rotary body in the axial direction.

8. The fixing device as claimed in claim 1, wherein the protruding portion includes an opening positioned to be spaced away from the heater.

9. The fixing device as claimed in claim 8, wherein the heater includes an axial end portion in the axial direction, and wherein at least a portion of the axial end portion of the heater is disposed within the opening.

10. The fixing device as claimed in claim 8, wherein the heater includes an axial end portion in the axial direction, and wherein a portion of the axial end portion of the heater aligned with the opening in the axial direction is completely received within the opening.

11. The fixing device as claimed in claim 1, wherein the endless belt comprises a base layer, a rubber layer coating the base layer as an intermediate layer, and a fluorine resin layer coating the rubber layer as an outermost layer.

12. The fixing device as claimed in claim 1, wherein the heater is a halogen lamp.

13. The fixing device as claimed in claim 1, wherein the main portion of the nip member has a second axial end portion opposite to the first axial end portion in the axial direction, the protruding portion being provided at each of the first axial end portion and the second axial end portion.

14. A fixing device comprising:
an endless belt;
a nip plate extending inside the endless belt;
a heater extending inside the endless belt, the heater directly facing the nip plate, the heater and the nip plate defining a first space therebetween where radiant heat from the heater toward the nip plate is to pass; and
a roller defining an axis extending in an axial direction, the roller and the nip plate being configured to nip the endless belt therebetween to form a nip region between the roller and the endless belt where a sheet is to be fed in a feeding direction,
wherein the nip plate comprises:
a main portion extending in the axial direction and having an end in the axial direction; and
a protrusion protruding from the end of the main portion toward the heater,
wherein the protrusion comprises:
a first surface exposed to the first space defined by the heater and the nip plate;
a second surface; and
an end face connecting the first surface and the second surface, the first surface and the second surface being positioned at sides opposite to each other with respect to the end face in the axial direction, the end face having:
a first end face facing upstream in the feeding direction;
a second end face facing downstream in the feeding direction; and
a third end face connecting the first end face and the second end face, the third end face facing in a predetermined direction parallel to a direction from the roller toward the nip plate and perpendicular to the axial direction, and
wherein a total area of the end face is smaller than a total area of the first surface.

15. The fixing device as claimed in claim 14,
wherein the roller and the nip plate oppose each other in an opposing direction, wherein an imaginary plane, extending parallel to the axial direction and the opposing direction and passing the nip region, passes through the protrusion.

16. The fixing device as claimed in claim 14, further comprising a reflection plate, the reflection plate and the nip plate defining a second space in which the heater is disposed, the second space including the first space,
wherein at least a portion of the protrusion is exposed to the second space.

17. The fixing device as claimed in claim 14, wherein the first surface and the end of the main portion define a boundary therebetween that extends in a direction intersecting the axial direction, at least a portion of the first surface being exposed to the first space defined by the heater and the nip plate.

18. The fixing device as claimed in claim 17, wherein the boundary extends in a direction perpendicular to the axial direction.

19. The fixing device as claimed in claim 14, wherein the first surface faces the heater in the axial direction for receiving radiant heat from the heater, at least a portion of the first surface being aligned with the heater in the axial direction.

20. A fixing device comprising:
an endless belt;
a nip plate extending inside the endless belt;
a heater extending inside the endless belt and directly facing the nip plate, the heater and the nip plate defining a first space therebetween where radiant heat from the heater toward the nip plate is to pass; and
a rotary body defining an axis extending in an axial direction, the rotary body and the nip plate being configured to nip the endless belt therebetween such that the rotary body and the endless belt form a nip region therebetween where a sheet is to be fed in a feeding direction,
wherein the nip plate comprises:
a main portion elongated in the axial direction; and
a protrusion protruding from the main portion toward the heater,
wherein the protrusion comprises:
a first surface exposed to the first space defined by the heater and the nip plate;
a second surface; and
an end face connecting the first surface and the second surface, the first surface and the second surface being positioned at sides opposite to each other with respect to the end face in the axial direction, the end face having:
a first end face facing upstream in the feeding direction;
a second end face facing downstream in the feeding direction; and
a third end face connecting the first end face and the second end face, the third end face facing in a predetermined direction parallel to a direction from the rotary body toward the nip plate and perpendicular to the axial direction, and
wherein a total area of the end face is smaller than a total area of the first surface.

21. The fixing device as claimed in claim 20, further comprising a reflection plate, the reflection plate and the nip plate defining a second space in which the heater is disposed, the second space including the first space,
wherein at least a portion of the protrusion is exposed to the second space.

* * * * *